US005611522A

United States Patent [19]

Zaguroli, Jr.

[11] Patent Number: 5,611,522

[45] Date of Patent: Mar. 18, 1997

[54] HYDRAULICALLY ACTUATED PORTABLE HOIST

[75] Inventor: James Zaguroli, Jr., Drayton Plains, Mich.

[73] Assignee: Knight Industries, Inc., Auburn Hills, Mich.

[21] Appl. No.: 627,248

[22] Filed: Apr. 1, 1996

[51] Int. Cl.[6] ..... B66D 1/10; F01B 3/00

[52] U.S. Cl. ..... 254/331; 254/323; 254/361

[58] Field of Search ..... 254/331, 360, 254/361, 362, 323, 385, 386

[56] References Cited

U.S. PATENT DOCUMENTS

| | | | |
|---|---|---|---|
| 3,003,748 | 10/1961 | Musser | 254/361 |
| 3,428,298 | 2/1969 | Powell | 254/331 |
| 3,675,899 | 7/1972 | McKendrick | 254/386 |
| 3,791,627 | 2/1974 | Stone et al. | 254/361 |
| 4,227,680 | 10/1980 | Hrescak | 254/344 |
| 4,623,124 | 11/1986 | Lewis | 254/361 |
| 5,046,402 | 9/1991 | Lagace | 254/361 |
| 5,205,544 | 4/1993 | Kroeger | 254/361 |
| 5,370,367 | 12/1994 | Zaguroli, Jr. | 254/360 |
| 5,492,306 | 2/1996 | Zaguroli | 254/360 |
| 5,522,581 | 6/1996 | Kulhavy | 254/360 |
| 5,553,832 | 9/1996 | Zaguroli, Jr. | 254/360 |

*Primary Examiner*—Katherine Matecki
*Attorney, Agent, or Firm*—John R. Benefiel

[57] ABSTRACT

A hoist is operated by a pair of hydraulic cylinders having output rods engaging a spool drum to selectively axially displace the drum on a ball screw to cause wind up of a load cable. The hoist is mounted on a mast and boom supported by a wheeled cart, with a battery powering a pump motor to raise the load. A selectively disabled check valve allows the weight of the load to lower itself by forcing fluid past the disabled check valve, returning the fluid to a reservoir.

6 Claims, 3 Drawing Sheets

HYDRAULICALLY ACTUATED PORTABLE HOIST

BACKGROUND OF THE INVENTION

This invention concerns hoists and more particularly fluid pressure actuated hoists in which a load cable is wound on a spool drum.

One form of such hoists commonly used in industrial plants is a pneumatic hoists operated with "shop air" commonly piped through the plant for use in operating various equipment used in manufacturing operations.

A particularly advantageous design is the air balancing hoists such as described in U.S. Pat. No. 3,428,298 issued on Feb. 18, 1969 for a "Tool Balancer." These hoists use a ball screw mechanism operated by a large diameter piston defining an air chamber which is advanced axially to push a ball nut mounted on a fixed ball screw. The ball nut is attached to a spool drum which is rotated as the nut advances axially. By precisely regulating the air pressure in the air chamber to an adjusted value, the weight of a load supported on a cable wound on a spool drum can be balanced. By increasing or decreasing the pressure, the cable is wound or unwound to raise or lower the load.

In such industrial plants, it is sometimes desirable to provide portable units to perform moderate lifting tasks at locations where an overhead hoist is not installed, and a connection to an air line is not practical. A self-contained fluid power source is thus provided, such portable fluid power sources are preferably battery-powered to avoid the need for wiring an electrical connection.

Battery power is used to generate fluid pressure to operate fluid power devices for lifting loads.

Battery-powered air compressors consume too much power for battery operation, and hence hydraulic power is used.

Power cylinders operated by hydraulic pressure are sometimes used to lift loads through a cable and pulley system, but the volume of hydraulic fluid required to operate the cylinders results in slow lifting speeds when limited by the battery operation and also results in rapid consumption of the available battery power. Also, the length of the cylinders required is excessive as the lifting distance is typically on the order of several feet.

Various displacement multipliers could be employed, such as the ball screw mechanism used in air balancing hoists, but again the volume of fluid typically required by integrated fluid pressure chambers is relatively large, resulting in slow lifting speeds and excessive battery power consumption.

The object of the present invention is to provide a hydraulic-powered lifting hoist which only requires minimal volume so as to be able to be operated at high speeds by a portable source of hydraulic fluid pressure.

SUMMARY OF THE INVENTION

The above object is achieved by a hoist in which a ball screw mechanism rotating the drum spool is operated by a plurality of symmetrically arranged low volume high pressure hydraulic power cylinders mounted to the hoist housing, with their output rods extending axially into the housing interior and engaging a thrust bearing interposed between the rod ends and the ball nut.

Fluid power is provided by a portable battery-powered motor driving a pump which pressurizes hydraulic fluid directed to a working chamber of each cylinder to cause stroking of the power cylinder actuator rods when the hoist is to raise a load. The operating rods axially displace the ball nut which rotates on a fixed ball screw and causes the drum spool to rotate to wind up the load cable and raise an attached load. A relatively small flow volume lifts the load a relatively great distance by the multiplier effect of the ball screw and the small volume displaced by the actuator rods.

The power cylinders are arranged radially offset from the axis of the ball nut and screw but diametrically opposite each other to balance the applied axial forces.

The hydraulic fluid is supplied via a solenoid controlled check valve so that the load is hydrostatically maintained at a given level by preventing reverse flow of fluid past the check valve. Selective opening of the check valve by operation of the solenoid allows the weight of the load acting on the cylinder pressure chambers to force the fluid back through the pump to the reservoir so that the load is allowed to descend to a lower level under the control of the solenoid.

The power cylinder housings are directly threaded into a hoist housing end wall to provide a simple, low cost construction.

Existing air balancing hoists can be converted to hydraulically-operated hoists at low cost to enable the same basic hoists to be useable with portable, battery-powered hoisting arrangements.

The hoist is preferably cart mounted on a mast and boom fixed to the cart while the battery pump and motor are also carried on the cart.

DETAILED DESCRIPTION

Figure 1:
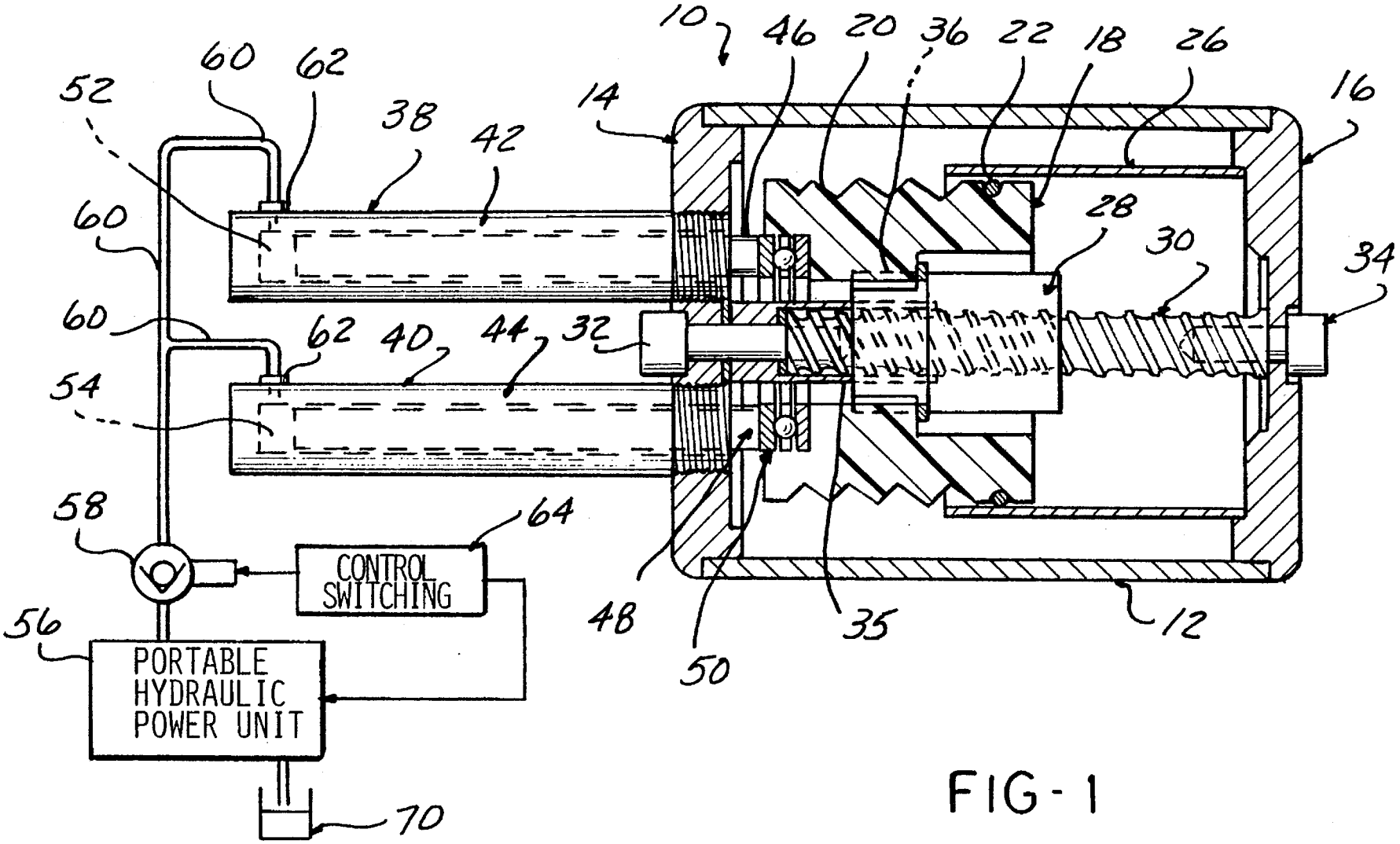
FIG. 1 is a horizontal partially sectional view taken through a hydraulically-operated hoist according to the present invention shown with the components in their relative position when a supported load is in the raised condition, with a diagrammatic representation of associated valving and portable hydraulic power unit used to operate the hoist.
Figure 2:
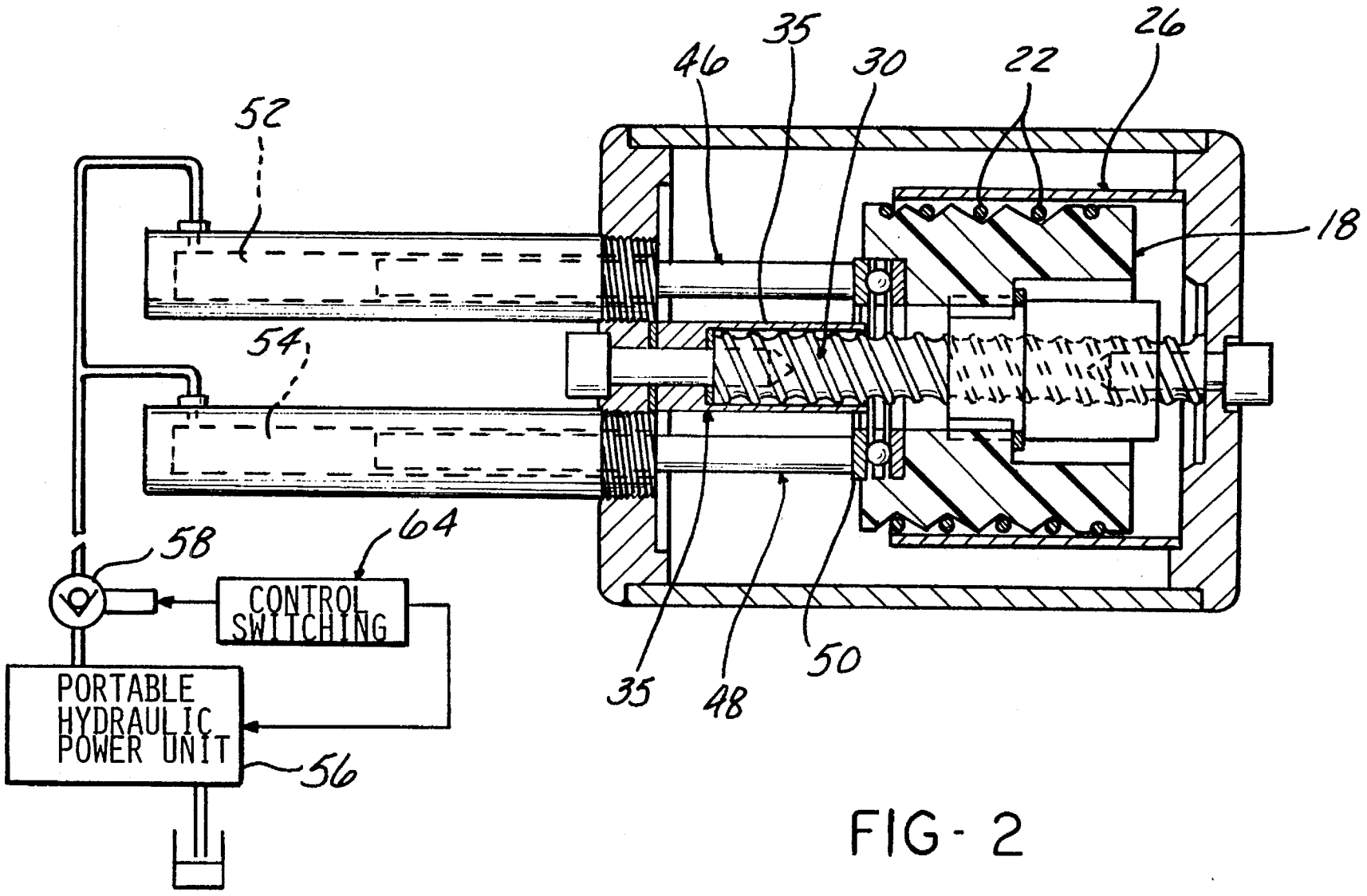
FIG. 2 is the same view of the hoist as FIG. 1, but with the components in their relative position when a supported load is in the lowered position.
Figure 4:
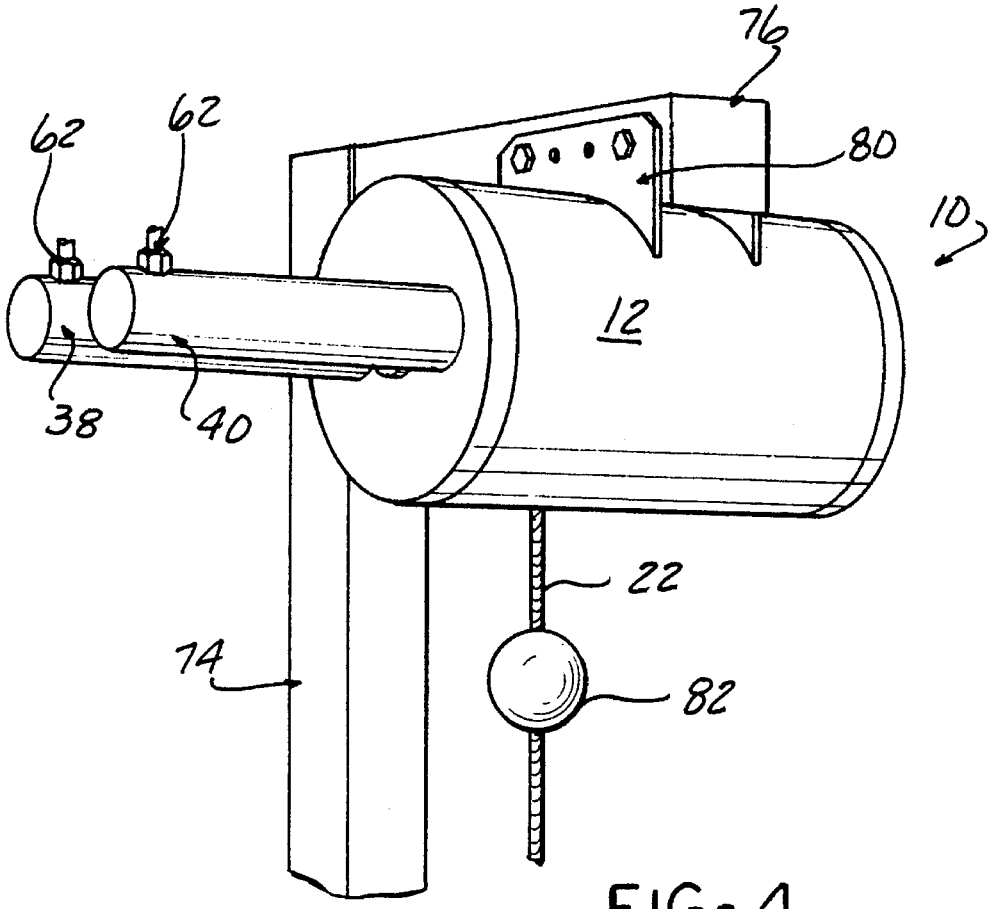
FIG. 4 is a perspective view of the hoist shown in FIGS. 1–3, as well as portions of supporting structure.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings, a hoist 10 is shown comprised of a cylindrical housing 12 having end cover plates 14, 16 fixed at either end.

A molded plastic spool drum 18 is rotatably mounted within the housing 12, having a helical groove 20 formed into the periphery thereof adapted to have a load cable 22 wrapped and unwrapped therein with rotation of the spool drum 18.

The cable 22 extends through an opening in the housing to allow attachment of a load 24 (FIG. 3) in the well known manner.

The spool drum 18 moves axially into a confinement liner sleeve 26 fixed to the end cover 16. The load cable 11 is thereby confined to be wrapped on the spool drum 18. A slot in the liner sleeve 26 allows the load cable 22 to pass out to the housing opening.

The spool drum 18 is rotated by the interaction between a ball nut 28 rotatably attached to the spool drum 18 and a ball screw 30 extending axially through the housing and fixed at either end to a respective housing cover 14 and 16 with cap screws 32, 34. The ball nut 28 is fixed to the spool drum 18 with a key 36.

A ball screw sleeve 35 covers the portion of the ball screw 30 to the left of the spool drum 18. This element was used to provide a sealing surface for the hub of a piston for a pneumatic balancer of which the present design is a conversion.

When the spool drum 18 is controllably powered to undergo axial travel within the housing 12, rotation is induced by the reaction between the ball nut 28 and the ball screw 30 to cause the cable 22 to be wrapped up and the load to be raised.

Figure 3:
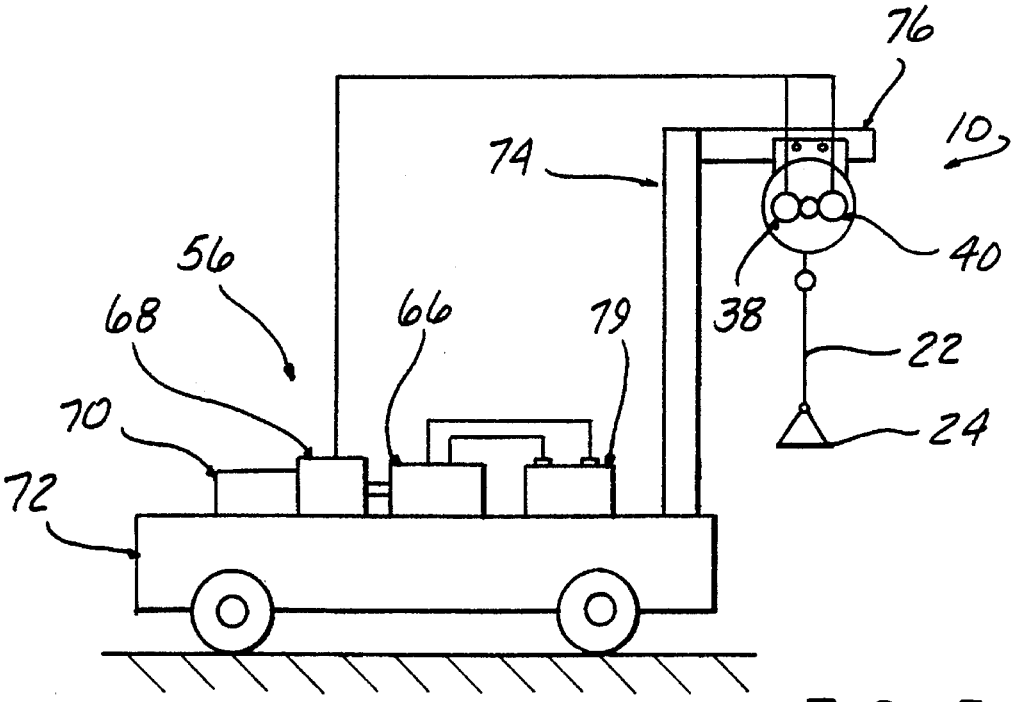
FIG. 3 is a simplified side elevational representation of a portable lifting apparatus incorporating the hoist controls and power unit shown in FIGS. 1 and 2.

According to the concept of the present invention, this axial travel is produced by a pair of low volume high pressure hydraulic power cylinders 38, 40 mounted to end caps 14 so as to extend parallel to the axis of the spool drum 18, but offset therefrom in diametrically opposite locations (FIG. 3).

Each cylinder 38, 40 has a cylindrical housing 42, 44 which may be formed with an external thread so as to be threaded into a bore in end cover 14.

An output rod 46, 48 of each cylinder 38, 40 extends axially into the interior of the housing 12 and each have one end contacting the side of a thrust bearing 50 protruding from the adjacent end of the spool drum 18.

The rods 46, 48 are received in bores in the cylinder housings 42, 44 to define pressure chambers 52, 54 with their opposite ends in the well known manner. Suitable cylinders 38, 40 are commercially available and the details thereof including seals, etc. are not shown for the sake of clarity.

The chambers 52, 54 are adapted to be pressurized by a battery-powered portable hydraulic power unit 56 communicating with chambers 52, 54 via an electrically-operated check valve 58 and suitable hydraulic lines 60 and fittings 62.

Control switching 64 is manually operable to activate the electric motor 66 driving a hydraulic vane or other non-positive displacement pump 68 included in the portable hydraulic power unit 56.

Hydraulic fluid under pressure then flows past check valve 58 to chambers 52, 54, causing the rods 46, 48 to extend, forcing the spool drum 18 to move axially to the right. The ball nut 28 and screw 30 cause rotation of the spool drum 18 in a direction to wind up the cable 22 and raise the load 24 as long as hydraulic fluid is caused to flow past the check valve 58.

Upon cessation of flow, the spool drum 18 is locked in position by hydrostatic pressure since reverse flow past valve 58 cannot occur.

When lowering of the load is desired, the control switching is operated to disable the valve 58, allowing the weight of the load 24 to force fluid past the pump 68 to the reservoir 70, so that the load descends until the valve 58 is again activated.

The portable hydraulic unit 56 is advantageously mounted on a wheeled cart 72 which also mounts a mast 74 and boom 76 supporting the hoist 10. The hoist 10 has bracketing 80 affixed to the top of the housing 12 for attachment to the boom 76. A cable stop 82 prevents overwinding of the load cable into the housing 12.

A storage battery 79 mounted on the cart 72 provides power for the electric motor 66.

Thus, the use of two symmetrically mounted hydraulic cylinders to drive the spool drum enables a low volume of incompressible hydraulic fluid to rapidly hoist loads, using a minimum of electrical energy to render a portable low capacity hoist practical. This hoist is readily created by converting existing pneumatically operated balancer hoists.

I claim:

1. A hoist comprising:

a housing;

a ball screw shaft fixed extending axially through said housing;

a ball nut revolvably received on said ball screw shaft;

a spool drum fixed to said ball nut and having a helical external groove formed thereon;

a load cable attached to said spool drum so as to be wrapped into and out of said groove upon rotation of said spool drum in either direction, said load cable having a free end passing out of said housing for attachment to a load;

a pair of hydraulic cylinders mounted to one end of said housing, each having a cylinder rod extending into said housing and drivingly engaging one end of said spool drum at diametrically opposite locations thereon, an opposite end of each of said rods defining a pressure chamber in a respective hydraulic cylinder; and means for selectively pressurizing each of said pressure chambers to cause each rod to extend axially to force said spool drum to be moved axially causing rotation thereof on said ball screw shaft so as to cause said load cable to wrapped thereon and an attached load to be thereby raised.

2. The hoist according to claim 1 wherein said means for pressurizing said chambers comprises a selectively activatable non-positive displacement pump causing flow of hydraulic fluid thereto.

3. The hoist according to claim 2 further including a one way check valve allowing flow in only one direction to said chambers.

4. The hoist according to claim 3 wherein said check valve is able to be selectively disabled to allow reverse flow.

5. The hoist according to claim 1 further including a mast and boom structure supporting said hoist, a wheeled cart supporting said mast and boom structure.

6. The hoist according to claim 5 further including a battery and an electric motor driving said pump.

* * * * *